US008991671B2

(12) United States Patent
Gill et al.

(10) Patent No.: US 8,991,671 B2
(45) Date of Patent: Mar. 31, 2015

(54) LOAD CARRIER DEVICE

(75) Inventors: Yoram Gill, Haifa (IL); Hanan Almus, Herzlia (IL); Meni Keinan, Haifa (IL)

(73) Assignee: Source Vagabond Systems Ltd., Tirat Hacarmel (IL)

( * ) Notice: Subject to any disclaimer, the term of this patent is extended or adjusted under 35 U.S.C. 154(b) by 96 days.

(21) Appl. No.: 13/994,000

(22) PCT Filed: Dec. 15, 2011

(86) PCT No.: PCT/IL2011/000945

§ 371 (c)(1),
(2), (4) Date: Oct. 2, 2013

(87) PCT Pub. No.: WO2012/081013

PCT Pub. Date: Jun. 21, 2012

(65) Prior Publication Data

US 2014/0014700 A1 Jan. 16, 2014

(30) Foreign Application Priority Data

Dec. 16, 2010 (IL) ..... 210054

(51) Int. Cl.

| | |
|---|---|
| ***A45F 3/14*** | (2006.01) |
| ***A45F 3/04*** | (2006.01) |
| ***A45F 3/08*** | (2006.01) |
| ***A45F 3/12*** | (2006.01) |

(52) U.S. Cl.

CPC ... *A45F 3/14* (2013.01); *A45F 3/04* (2013.01); *A45F 3/047* (2013.01); *A45F 3/08* (2013.01); *A45F 3/12* (2013.01); *A45F 2003/045* (2013.01); *A45F 2003/122* (2013.01); *A45F 2003/127* (2013.01); *A45F 2003/144* (2013.01)

USPC ..... 224/628; 224/631; 224/637

(58) Field of Classification Search

CPC ..... A45F 3/08; A45F 2003/045
USPC ..... 224/627, 628, 631, 633, 634, 636, 637
See application file for complete search history.

(56) References Cited

U.S. PATENT DOCUMENTS

| | | | | |
|---|---|---|---|---|
| 3,889,859 | A | 6/1975 | Joseph | |
| 4,982,884 | A * | 1/1991 | Wise | 224/634 |
| 5,644,792 | A | 7/1997 | Tishler et al. | |
| 5,823,414 | A * | 10/1998 | Gal et al. | 224/637 |
| 5,954,253 | A | 9/1999 | Swetish | |

(Continued)

FOREIGN PATENT DOCUMENTS

EP 1618813 A2 * 1/2006

OTHER PUBLICATIONS

International Search Report for Application No. PCT/IL2011/000945, mailed on May 10, 2012.

*Primary Examiner* — Justin Larson
(74) *Attorney, Agent, or Firm* — Pearl Cohen Zedek Latzer Baratz LLP

(57) ABSTRACT

A load carrier device for enabling a user to carry a load includes a belt for fastening about a waist of the user and an element of substantial vertical rigidity configured to exert a lifting force on the load when the load is attached to shoulder straps on shoulders of the user. The device further includes an adjustable elastic connection attached to the belt for supporting a lower end of the element of substantial vertical rigidity such that adjusting the adjustable elastic connection changes a distribution of a weight of the load between the shoulders and the waist of the user.

14 Claims, 9 Drawing Sheets

(56) References Cited

U.S. PATENT DOCUMENTS

| | | | | |
|---|---|---|---|---|
| 7,152,771 | B2 * | 12/2006 | Le Gal et al. | 224/631 |
| 7,287,677 | B2 * | 10/2007 | Reid | 224/637 |
| 8,857,681 | B2 * | 10/2014 | Burnett et al. | 224/197 |
| 2002/0104862 | A1 | 8/2002 | Dexheimer | |
| 2003/0132260 | A1 | 7/2003 | Prather | |
| 2006/0000856 | A1 | 1/2006 | West | |
| 2006/0151559 | A1 * | 7/2006 | Gravseth | 224/637 |
| 2006/0289589 | A1 * | 12/2006 | Gregory | 224/631 |
| 2008/0010730 | A1 | 1/2008 | Twito et al. | |
| 2011/0198377 | A1 * | 8/2011 | Froidevaux et al. | 224/633 |
| 2013/0283492 | A1 * | 10/2013 | Ernst et al. | 2/44 |
| 2013/0312150 | A1 * | 11/2013 | Klein | 2/2.5 |
| 2014/0001220 | A1 * | 1/2014 | Brensinger et al. | 224/637 |
| 2014/0151424 | A1 * | 6/2014 | Hexels | 224/637 |

* cited by examiner

LOAD CARRIER DEVICE

CROSS-REFERENCE TO RELATED APPLICATIONS

This application is a National Phase Application of PCT International Application No. PCT/IL2011/000945, International Filing Date Dec. 15, 2011, claiming priority of Israeli Patent Application No. 210054, filed Dec. 16, 2010, which is hereby incorporated by reference.

FIELD OF THE INVENTION

The present invention relates to a load carrier device.

BACKGROUND OF THE INVENTION

Personnel moving on foot are often required to carry a large amount of equipment. Such personnel may include firefighters, infantry soldiers, law enforcement personnel, hikers, and forest rangers. For example, an infantry soldier, depending on the nature of a particular task or mission, may be required to carry weapons, ammunition, water, food, body armor, tools, communication equipment, and reconnaissance equipment. The weight of this equipment may be substantial (e.g. similar to the weight of the body of the person carrying the load).

Since the items carried by users of a load bearing system typically vary from user to user, and from occasion to occasion, many such systems include interchangeable components. A typical system may be designed with various interchangeable front and back panels. For example, different types of panels may be provided with different distributions of pockets and equipment carriers. As another example, a panel may be provided with a pocket or other arrangement enabling insertion of a plate of body armor. The type and thickness of the armor plate may be selected in accordance with an anticipated need for the purpose of a particular task or mission. For example, a load bearing system with interchangeable panels has been described by Tishler et al. in U.S. Pat. No. 5,644,792.

In many carrier systems designed to carry such equipment, the weight of such equipment is borne only by the shoulders of the person carrying the load. The result may be excessive force on the person's shoulder and back. In addition to causing discomfort to the person carrying the equipment, the excessive force could lead to back pain or injury.

In order to reduce excessive forces on the shoulders and back, load bearing systems have been designed that include a belt or band. The belt or band may be placed around the person's waist. In this manner, the belt or band may at least partially support the load. Thus, at least part of the load may be supported by the person's waist or pelvic area. For example, a load bearing system that includes a waist belt has been described by Twito et al. in US publication 2008/0010730.

However, even when the weight load is shared by the shoulders and the waist, the distribution of the weight may not be optimal or comfortable. In addition, while carrying a load, the optimal distribution of the weight may change. For example, as a part of the body that is bearing most of the weight load becomes fatigued, it may be more comfortable to redistribute the weight load. In addition, a load that is connected to both shoulder straps and a waist belt may restrict movement of the body. For example, a person carrying such a load may have difficultly bending the upper part of the body.

It is an object of the present invention to provide a load carrier device that enables a person to comfortably and effectively carry a load.

Other aims and advantages of the present invention will become apparent after reading the present invention and reviewing the accompanying drawings.

SUMMARY OF THE INVENTION

There is thus provided, in accordance with some embodiments of the present invention, a load carrier device for enabling a user to carry a load includes a belt for fastening about a waist of the user and an element of substantial vertical rigidity configured to exert a lifting force on the load when the load is attached to shoulder straps on shoulders of the user. The device further includes an adjustable elastic connection attached to the belt for supporting a lower end of the element of substantial vertical rigidity such that adjusting the adjustable elastic connection changes a distribution of a weight of the load between the shoulders and the waist of the user.

Furthermore, in accordance with some embodiments of the present invention, the element of substantial vertical rigidity includes one or more connectors for connecting to the load or to a harness that includes the shoulder straps.

Furthermore, in accordance with some embodiments of the present invention, the elastic connection includes a sheath elastically connected to the belt for supporting a lower end of the element of substantial vertical rigidity.

Furthermore, in accordance with some embodiments of the present invention, the device includes a strap attached to the elastic connection for adjusting the lifting force whereby applying tension to the strap increases a tension of the elastic connection.

Furthermore, in accordance with some embodiments of the present invention, the strap includes a stop arrangement for maintaining the applied tension.

Furthermore, in accordance with some embodiments of the present invention, the elastic connection includes a silicone band.

Furthermore, in accordance with some embodiments of the present invention, the device includes the shoulder straps.

Furthermore, in accordance with some embodiments of the present invention, the shoulder straps are part of a harness.

Furthermore, in accordance with some embodiments of the present invention, the harness includes webbing.

Furthermore, in accordance with some embodiments of the present invention, the element of substantial vertical rigidity includes one or more connectors for connecting to the webbing.

Furthermore, in accordance with some embodiments of the present invention, the harness includes abdomen flaps for fastening about the torso of the user.

Furthermore, in accordance with some embodiments of the present invention, the harness includes an attachment element for attaching a load-carrying accessory.

Furthermore, in accordance with some embodiments of the present invention, the attachment element is selected from a group of attachment elements consisting of: a surface of hook-and-loop fastener material, a buckle, a strap, and a tab pocket.

Furthermore, in accordance with some embodiments of the present invention, the harness includes a lower torso harness that includes abdomen flaps for fastening around a lower torso of the user, and a shoulder harness that includes the shoulder straps, the lower torso harness and the shoulder harness being separately attachable to the element of substantial vertical rigidity.

Furthermore, in accordance with some embodiments of the present invention, the harness includes an integrated soft ballistic panel.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF EMBODIMENTS

Figure 1:
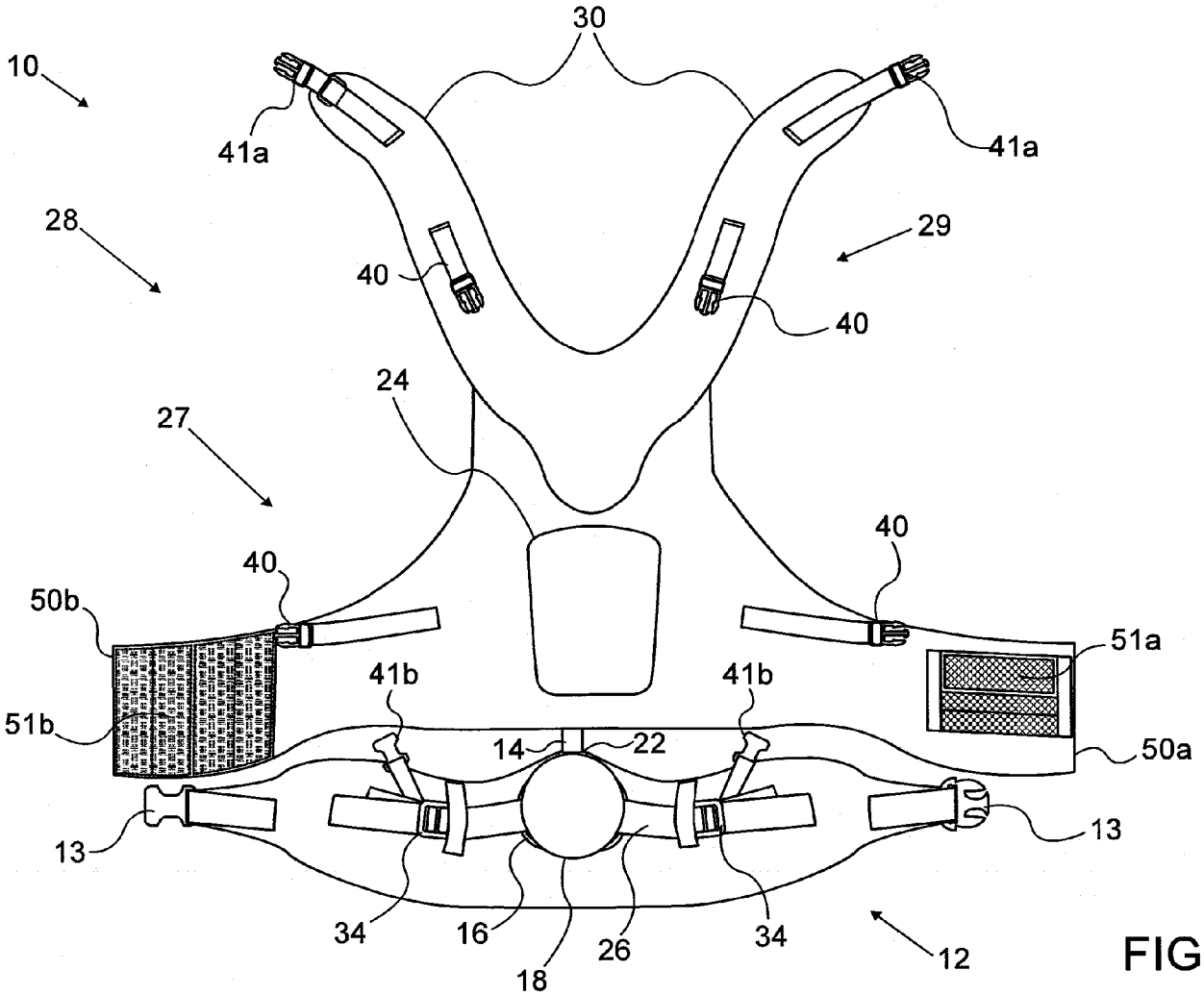
FIG. 1 shows a load carrier device in accordance with an embodiment of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

A load carrier device, in accordance with embodiments of the present invention, includes a waist belt for fastening about a waist of the user. An element of substantial vertical rigidity is configured to exert a lifting force on the load when the load is attached to shoulder straps on shoulders of the user. An adjustable elastic connection is attached to the belt for supporting a lower end of the element of substantial vertical rigidity. Adjusting the adjustable elastic connection changes a distribution of a weight of the load between the shoulders and the waist of the user.

The shoulder straps may be included as part of a harness. The harness may be configured to carry the load. For example, one or more load carrying accessories (e.g. backpack or equipment carrier panel) may be attached to the harness. A "shoulder strap" in the context of the present specification is understood to include any supporting arrangement that is designed to be placed over a shoulder of the user so as to allow the user to conveniently carry a load that is attached to the shoulder straps, where the shoulders support all or part of the load. For example, shoulder straps may include straps or pads.

The harness includes one or more rigid elements. For example, the harness may include a substantially rigid plastic panel. The harness may also include the element of substantial vertical rigidity such that the element of substantial vertical rigidity extends vertically within the harness. For example, the element of substantial vertical rigidity may include an insertable spine bar at the back of the harness (as typically worn by the user).

The vertical rigid element may attach to the waist belt via the connection. The connection may be adjustable so as to adjust a lifting force exerted on the element of substantial vertical rigidity. For example, the connection may include an element (e.g. a motorized, elastic, or hydraulic actuator) that may be controlled so as to adjust the lifting force. Typically, the connection may enable relative freedom of movement and rotation between the vertical rigid element and the waist belt. For example, the connection may enable freedom of movement in several or all directions, and freedom of rotation about several or all axes.

The connection may be an elastic connection. An elastic connection may enable at least limited flexibility between the vertical rigid element and the waist belt in every direction and about every axis. For example, the elastic connection may include one or more elastic bands. The tension of the elastic connection may be adjustable by the user when wearing the load carrier device. For example, the elastic connection may be provided with one or more (typically two) straps. The user may pull on the straps to increase the tension of the elastic connection, or release the straps to decrease the tension. The elastic connection may be configured to increase a lifting force on the vertical rigid element when the tension of the elastic connection is increased. Increasing the tension and the lifting force may transfer a portion of the weight of the load carried by the harness from the shoulder straps to the waist belt. On the other hand, decreasing the tension may transfer a portion of the weight of the load from the waist belt back to the shoulder straps. Thus, a user wearing the load carrier device may conveniently, and typically without interrupting other activities such as walking, shift a load at back and forth between the user's waist and the user's shoulders. For example, the user may shift the load in accordance so as to maintain or increase the user's comfort, or to avoid strain or fatigue.

The harness may include other features, such as a closable abdomen strap, for maintaining the load close to the user's center of gravity, and thus maintaining the stability of the load and the user carrying the load.

A load carrier device, in accordance with an embodiment of the present invention, includes a waist belt, a spine bar, and a torso harness.

The waist belt is configured to be fastened about the waist of a user who is wearing the load carrier device. The waist belt may be fastened about the user's waist, typically in front of the user, by using buckles or other fasteners (e.g. hooks, latches, or hook-and-loop fasteners).

The waist belt includes two straps. An end of each strap (typically the end that is positioned behind a user who is wearing the load carrier device) is connected to an elastic (herein understood to refer to being both flexible and resilient) band or other flexible and elastic connecting strip or band. The elastic band holds the end to a spine bar sheath and to the corresponding end of the other strap. The spine bar sheath is configured to support the lower end of the spine bar. Pulling the straps away from one another may stretch the elastic band attaching each strap to the spine bar sheath, thus apply a lifting force to the spine bar sheath and the spine bar. Typically, the straps are provided with a mechanism (e.g. a buckle) that may restrain the straps in a pulled position, thus maintaining tension on the elastic band. Releasing the straps enable the elastic tension to relax, pulling the straps rearward.

The components of the torso harness may attach to the spine bar. Typically, the torso harness includes a lower torso harness and a shoulder harness. The torso harness may be configured to support a variety of loads. Typically, a front panel may be attached to a front side (when worn by a user) of the torso harness, and a backpack or other equipment carrier may be attached to the rear side.

In accordance with some embodiments of the present invention, the lower torso harness and the shoulder harness are detachable from one another. When assembled into a torso harness, the lower torso harness and the shoulder harness are capable of a limited amount of independent movement. The capability for independent movement may enable greater freedom of movement for a user that is wearing the torso harness. Typically, both the lower torso harness and the shoulder harness include appropriate attachment connectors, supports, or panels for supporting a load that is carried in front of, or behind a user wearing the torso harness.

In accordance with embodiments of the present invention, a rear side of the lower torso harness includes one or more approximately vertical sleeves (or horizontal loops). When assembling the load carrier for use, the spine bar may be made to pass vertically through the sleeves. A top end of the spine bar may support a bracket on the torso harness. Typically, the bracket may be in the form of a socket, such as a pocket of the lower torso harness. The spine bar pocket opens at the bottom to enable insertion of the end of the spine bar, and is closed at the top. Thus, pushing upward on the spine bar may cause the spine bar to push upward on the spine bar pocket, and thus on the lower torso harness. A portion of the spine bar remains outside the sleeves and the spine bar pocket for attachment of the shoulder harness.

The lower torso harness includes two straps that end in abdomen flaps. The abdomen flaps are configured to close over and securely attach to one another in front of the user. For example, regions of facing surfaces of the abdomen flaps may be covered with mating surfaces of a hook-and-loop fastener material. Securely closing the abdomen flaps may retain the spine bar close to the user's back.

The shoulder harness includes shoulder straps that are attached to the rear of the shoulder harness (when worn by a user). The shoulder straps are configured to fit over the shoulders of a user, and to attach to an attachment point that is typically on the lower torso harness. The shoulder harness may include a connector for connecting to a load that is carried either in front of or behind the user. Thus, the shoulder straps may at least partially support the load.

The shoulder harness includes a sleeve or loop for a section of the spine bar (typically a section that is not covered by a sleeve or spine bar pocket of the lower torso harness) to pass through. The dimensions of the opening of the loop or sleeve are typically slightly larger than the width and thickness of the spine bar. Thus, the shoulder harness may be held against the spine bar. However, the shoulder harness may move (to a limited extent) independently of the lower torso harness. The independent motion may allow a user of the load carrier device more freedom of motion than would be allowed if the shoulder harness were firmly attached to the lower torso harness.

When an upward force is applied upward on the spine bar such that the spine bar exerts an upward force on the lower torso harness, the lower torso harness may exert an upward force on the shoulder harness. Thus, the weight of a load that is supported by the shoulder harness may be shifted such that it is at least partially supported by the spine bar sheath and the waist belt. Thus, a user may pull forward or release straps of the waist belt to simply, conveniently, and dynamically shift the weight of a load between the shoulder straps and the waist belt.

FIG. 1 shows a load carrier device in accordance with an embodiment of the present invention. Load carrier device 10 is shown as opened, and is viewed from the rear (as typically worn by a user). Load carrier device 10 includes waist belt 12 and torso harness 28. Torso harness 28 includes lower torso harness 27, and shoulder harness 29. Spine bar 14 extends upward from spine bar sheath 18 of waist belt 12, and through lower torso harness 27 to shoulder harness 29 of torso harness 28. Alternatively, a torso harness may be a single unit including features of both a lower torso harness and a shoulder harness.

Waist belt 12 may be secured to the waist of a user by a closing device 13. Typically, closing device 13 may include a quick release buckle. Alternatively, closing device 13 may include a buckle, latch, hook, a surface of hook-and-loop fastener material, or any other belt closure known in the art.

Figure 3A:
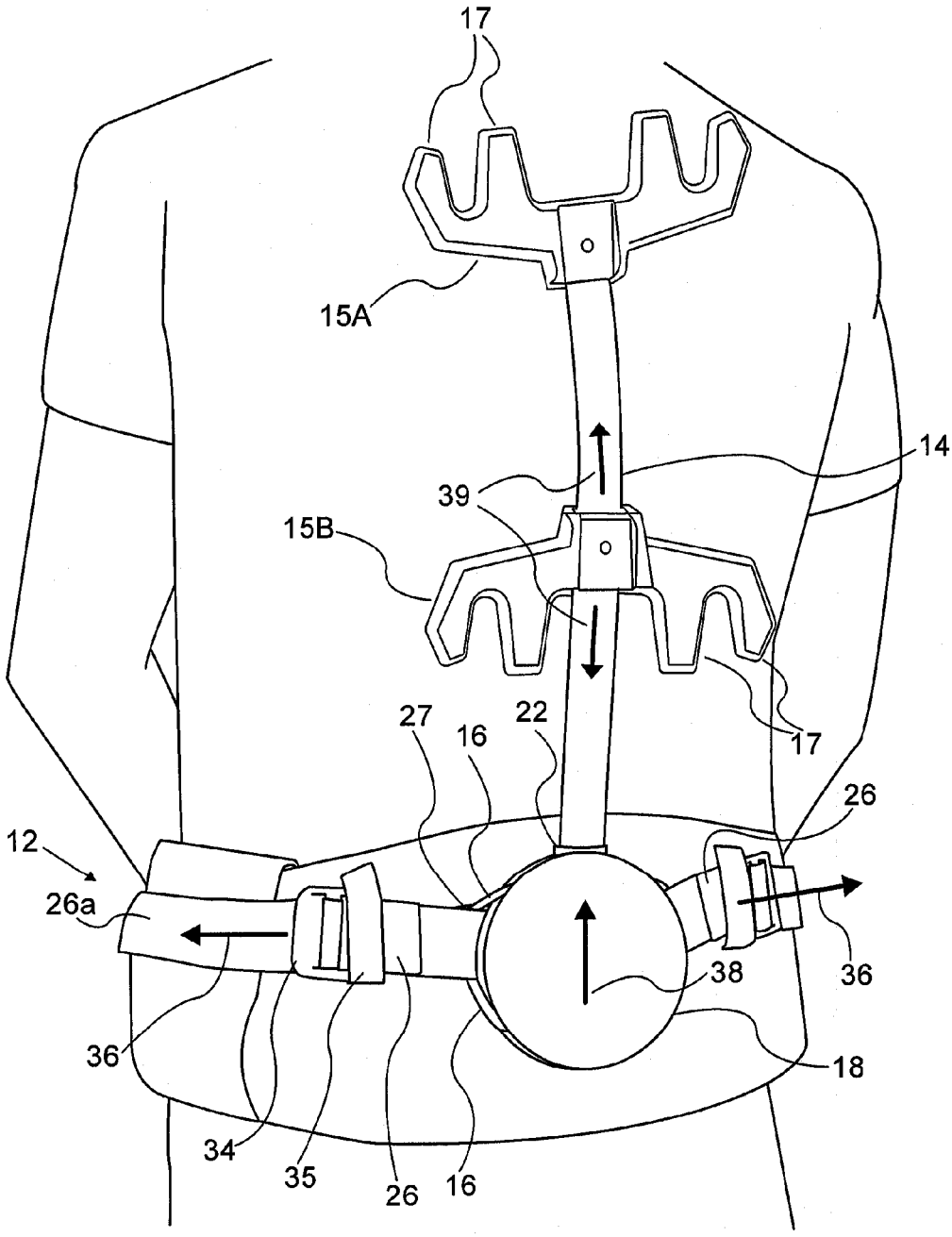
FIG. 3A illustrates application of upward force by a load carrier device in accordance with an embodiment of the present invention.
Figure 3B:
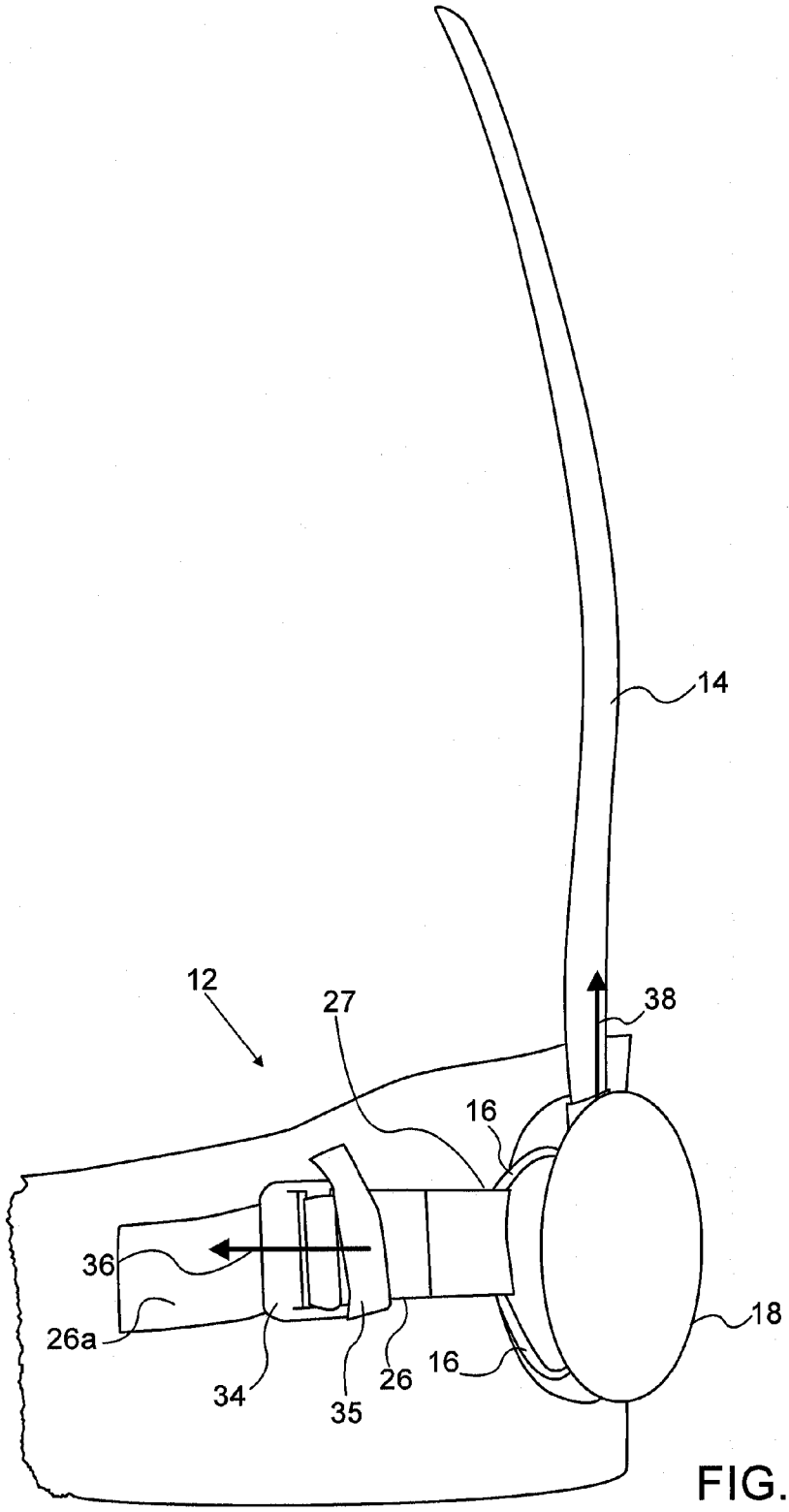
FIG. 3B is another view of application of upward force by a load carrier device.

Spine bar 14 is typically contoured so as to approximately match the form of a typical user's spine (as shown in FIG. 3B). A spine bar may be selected or adjusted so as to more closely match the shape or size of the back of a specific user or class of users.

The length of spine bar 14 may be typically adjusted or selected so as to match the distance between the waist and shoulders of a specific user. For example, spine bar 14 may include two sections configured such that an end of one section may be inserted into an opening of the other section in telescoping fashion. The length that is inserted may be increased or decreased so as to adjust the length of spine bar 14 to fit a specific user.

Such a telescoping spine bar may be provided with appropriately spaced stops so as to fix the length of the spine bar at a selected length. For example, one of the telescoping sections may be provide with one or more extendable pins, while the other section may be provided with a plurality of corresponding openings or slots along its length. By extending the pin (either manually or by means of a spring) so as to insert the pin into one of the openings, the length of the spine bar may be fixed. Alternatively, both telescoping sections may be provided with a plurality of holes. When a hole of one section aligns with a hole of the other section, a pin, rivet, bolt, or screw may be inserted through the aligned holes so as to fix the length of the spine bar.

Alternatively to a telescoping spine bar, two or more sections of a spine bar may be connected to one another externally in a variable manner to form a spine bar of a desired length. For example, one section may be provided with a set of holes, while another section may be provided with a corresponding set of pins. Insertion of the pins of section into the holes of the other section may enable the sections to be joined to form a single spine bar. Selection of which pins to insert into which holes may determine the length of the spine bar. Alternatively, both sections may be provided with holes. Aligning the holes and inserting a pin, screw, bolt, or rivet through one or more of the aligned pairs of holes may form a spine bar of a desired length.

Alternatively to a spine bar having an adjustable length, a spine bar 14 of appropriate length may be selected from a set of spine bars of various lengths. The selected spine bar 14 may then be inserted or attached between waist belt 12 and torso harness 28 of load carrier device 10.

The lower end of spine bar 14 may be inserted into spine bar opening 22 of spine bar sheath 18. Spine bar opening 22 may be configured to maintain spine bar 14 in an approximately fixed orientation with respect to spine bar sheath 18.

For example, spine bar opening 22 may be shape so as to restrict movement of spine bar 14. Typically, spine bar sheath 18 may maintain spine bar 14 in an approximately upright or vertical orientation when load carrier device is properly worn by a user who is standing. In order to prevent accidental withdrawal of spine bar 14 from spine bar opening 22, e.g. due to motion of the user's body, the lower end of spine bar 14 may be permanently or removably fixed to spine bar sheath 18.

Alternatively, spine bar 14 may be attached to spine bar sheath 18 such that no restricting opening is required to maintain spine bar 14 in an approximately fixed orientation with respect to spine bar sheath 18. For example, spine bar 14 may be attached to spine bar sheath 18 at two or more attachment points such as to maintain spine bar 14 in an approximately fixed relative orientation.

Spine bar sheath 18 may constructed so as to be substantially rigid. Being substantially rigid component may assist in enabling spine bar sheath 18 to substantially maintain its shape when subject to stress forces. For example, a rigid plate may be constructed of a rigid plastic or metal.

Components of torso harness 28 may be attached to spine bar 14. Torso harness 28 is designed to fit over the torso of a user. Sections of torso harness 28 may incorporate a padding or lining. Such a padding or lining may include soft ballistic panel material. For example, an integrated soft ballistic panel may be enclosed by layers of fabric.

Torso harness 28 includes shoulder straps 30. Shoulder strap connectors 41*a* on shoulder straps 30 may be connected to shoulder strap connectors 41*b* on waist belt 12 so as to fasten shoulder straps 30 over a user's shoulders. For example, shoulder strap connectors 41*a* and 41*b* may include mating pairs of side-release buckles, of buckles, snaps, buttons and button holes, side-release buckles, straps, surfaces of hook-and-loop fastener material, laces and eyelets, or any other connector for attaching a strap known in the art.

Torso harness 28 is typically designed to carry one or more loads. For example, torso harness 28, in accordance with some embodiments of the present invention, may be provided with one or more connectors 40. For example, connectors 40 may be in the form of buckles, snaps, buttons, side-release buckles, straps, laces, eyelets, or surfaces of hook-and-loop fastener material. Connectors 40 may be mated with corresponding components of a load so as to connect the load to torso harness 28. A load may include, for example, a load carrying panel or a backpack.

Figure 2A:
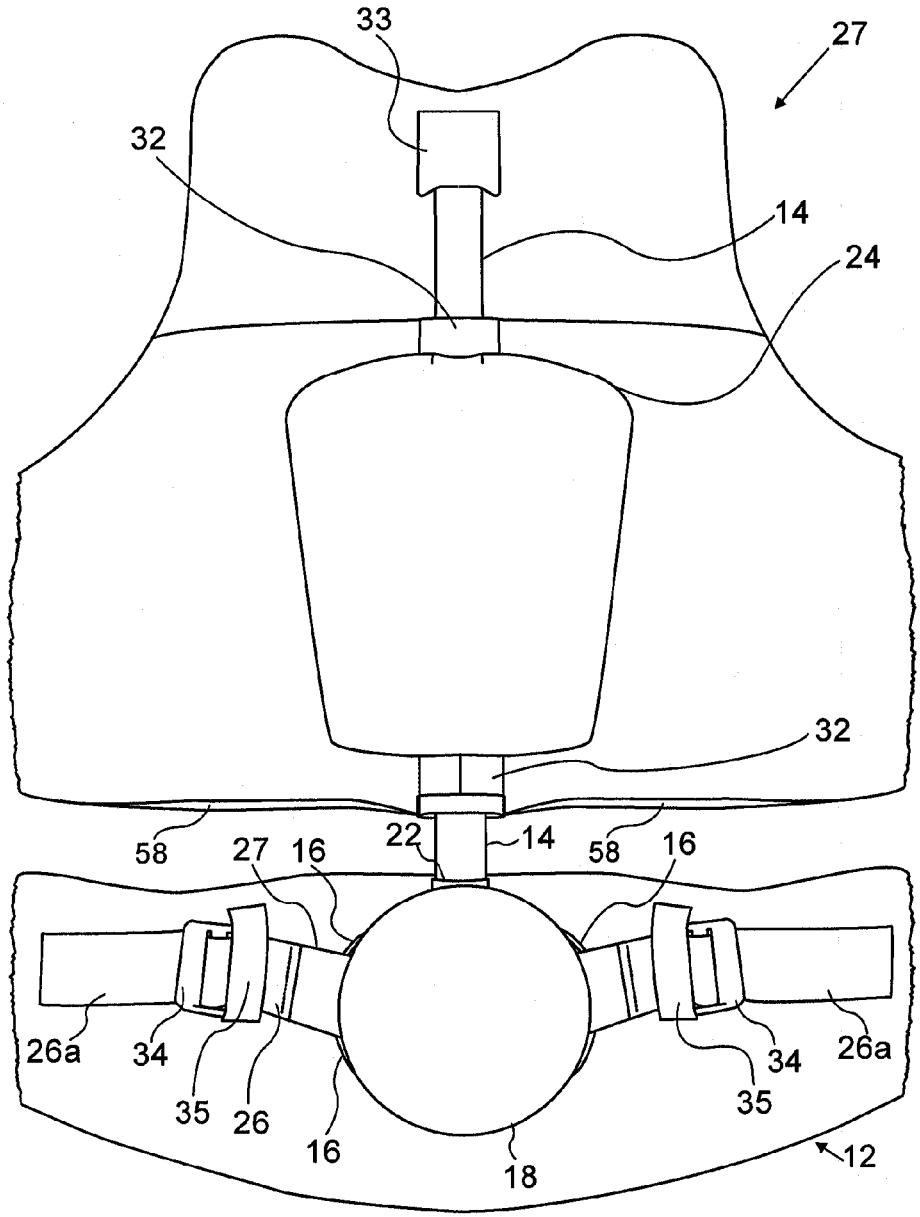
FIG. 2A illustrates attachment of a lower torso harness to a spine bar of the load carrier device shown in FIG. 1.
Figure 2B:
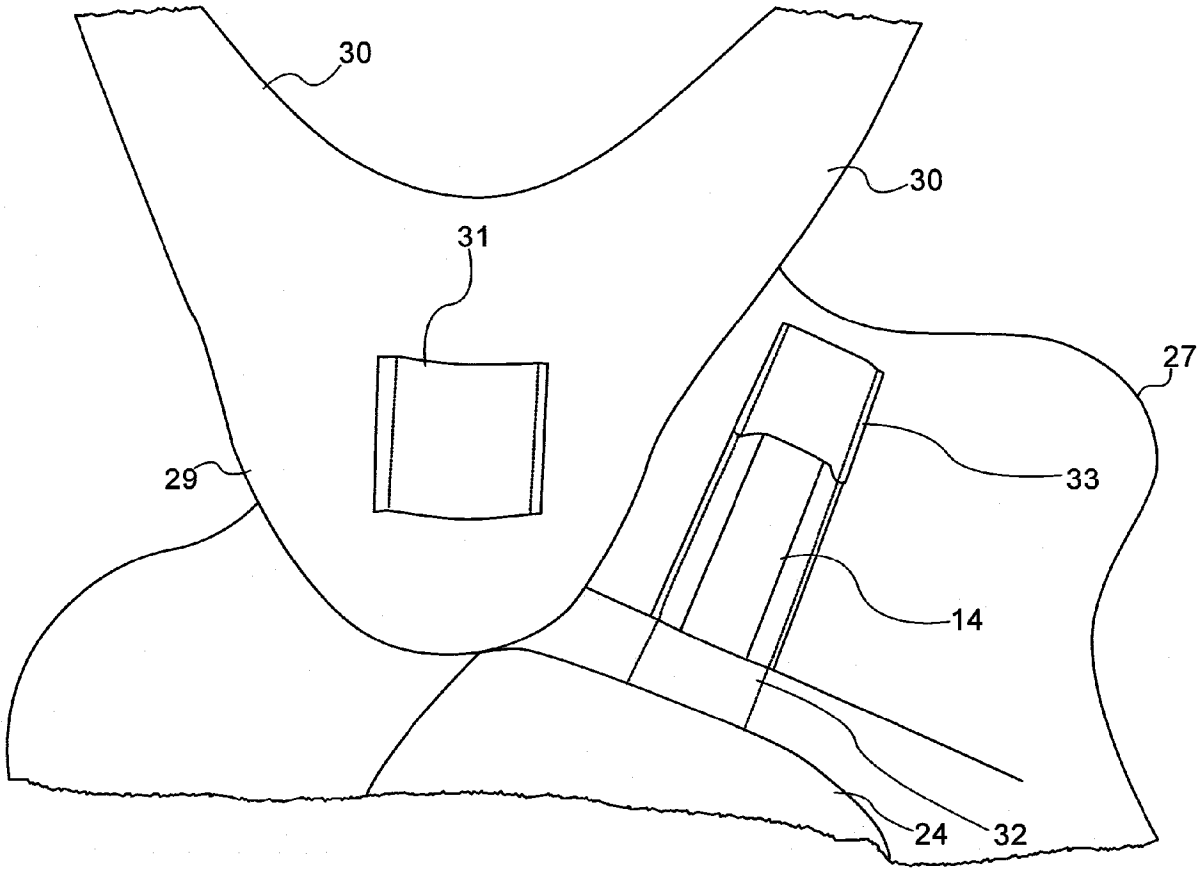
FIG. 2B illustrates attachment of a shoulder harness to a spine bar of the load carrier device shown in FIG. 1.

FIG. 2A illustrates attachment of a lower torso harness to a spine bar of the load carrier device shown in FIG. 1. FIG. 2B illustrates attachment of a shoulder harness to a spine bar of the load carrier device shown in FIG. 1. Spine bar 14 may pass through sleeve 32 of lower torso harness 27. An upper end of spine bar 14 may be inserted into spine bar pocket 33. Typically, the interior dimensions of sleeve 32 and spine bar pocket 33 are slightly larger than the exterior dimensions of spine bar 14. Thus, when spine bar 14 is inserted into sleeve 32 and spine bar pocket 33, lateral relative movement between spine bar 14 and lower torso harness 27 may be limited. Alternatively to sleeve 32, lower torso harness 27 may be provided with an aligned set of smaller loops or sleeves.

Prior to insertion of the upper end of spine bar 14 into spine bar pocket 33, the upper end of spine bar 14 may be inserted through spine bar sleeve 31 of shoulder harness 29. (Spine bar sleeve 31 is located on a side of shoulder harness 29 that typically faces inward when worn by a user. In FIG. 2B, shoulder harness 29 is shown inverted with the typically inward-facing side facing outward.) Thus, when the upper end of spine bar 14 is inserted into spine bar pocket 33, shoulder harness 29 may be held to spine bar 14.

Lower torso harness 27, in accordance with some embodiments of the present invention, may be provided with include abdomen closure flaps 50*a* and 50*b*. Abdomen closure flaps 50*a* and 50*b* may be closed, typically over the user's abdomen, in order to secure lower torso harness to the user's body. For example, securing lower torso harness 27 to the user's body may assist in ensuring that a load carried by load carrier device 10 may be held in a comfortable and stable manner. For example, proper use of load carrier device 10 may ensure that the center of gravity of a carried load remains close to the axis of the user's body.

For example, an outer surface of an abdomen closure flap 50*a* may include an attachment surface 51*a*, such as a surface that includes a hook-and-loop fastener material. A mating surface on an inner surface (not shown) of the opposite abdomen closure flap 50*b* may be fastened to attachment surface 51 a when abdomen closure flaps 50*b* overlaps abdomen closure flap 50*a*. Alternatively, abdomen closure flaps 50*a* and 50*b* may be closable using latches, hooks, buttons, snaps, bands, laces, buckles, or any other method for closing flaps known in the art. An outer surface of abdomen closure flap 50*b* may include an outward facing attachment surface 51*b*. Outward-facing attachment surface 51*b* may enable attaching a panel or other suitable component to abdomen flap 50*b*.

Figure 5A:
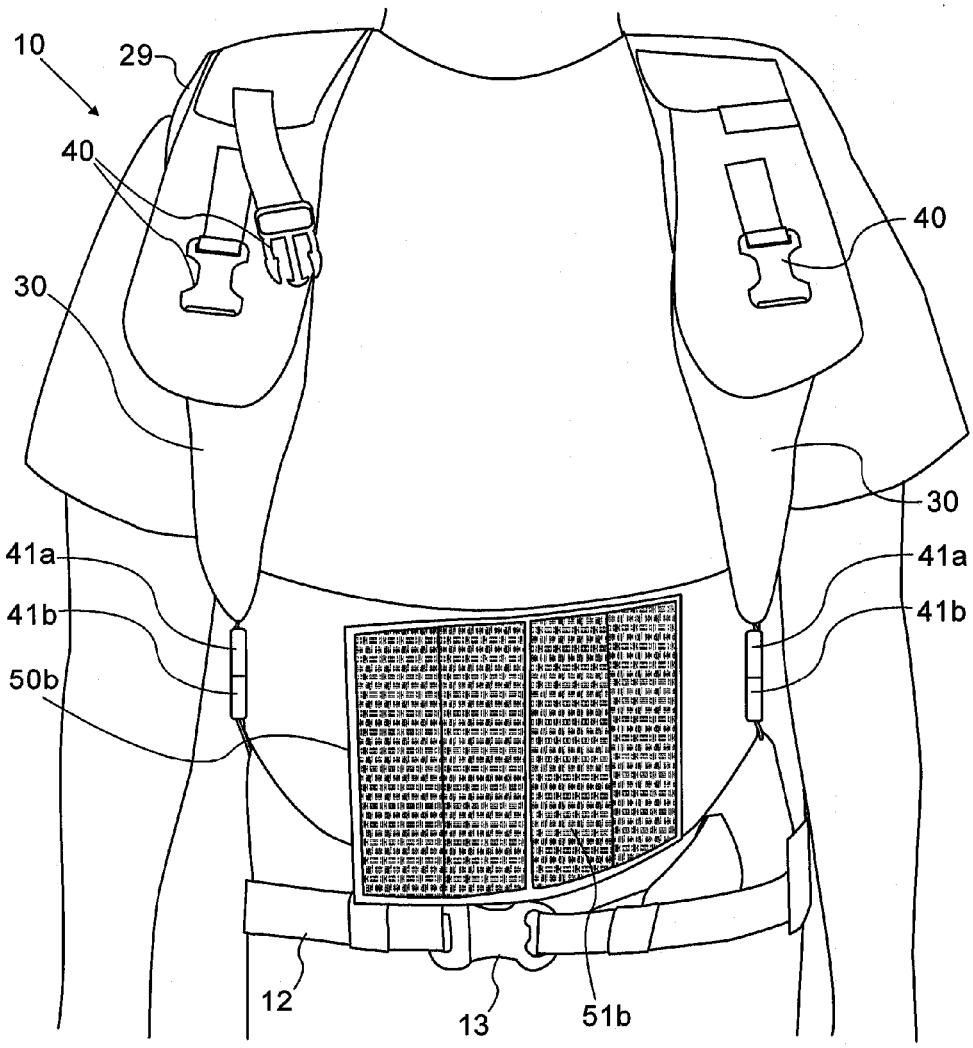
FIG. 5 illustrates attachment of an example of a front carrier panel to a load carrier device in accordance with some embodiments of the present invention.

Shoulder straps 30 of shoulder harness 29 may include padding, or may be otherwise designed to minimize discomfort. When a user wears load carrier device 10 in order to carry a load, shoulder straps 30 are typically arranged over the user's shoulders. Typically, one or more attachment devices 40 are attached near the distal ends of shoulder straps 30. The distal ends may typically be attached to an appropriate device on lower torso harness 27 (as shown in FIG. 5A).

Lower torso harness 27 may be provided with tab pocket 24. For example, a load, such as a backpack, may include a tab that is designed to fit into tab pocket 24. When a tab of a load is placed into tab pocket 24, lower torso harness 27 may support the load. Alternatively or in addition, a connector for supporting a backpack or similar load carrying accessory may be provided.

Lower torso harness 27 may also include one or more compartments configured to accommodate a panel or plate and hold it in place (in addition to any soft padding or plate material, such as integrated soft ballistic paneling, incorporated into the structure of lower torso harness 27). A panel or plate may be inserted into the plate compartment through plate compartment opening 58 at a bottom edge of lower torso harness 27. For example, a plate may include a rigid ceramic ballistic plate, or other body armor components. The shape of the inserted plate may closely match the shape the plated compartment into which it is inserted. Attachment or closure means may be provided to hold a panel in place within the compartment. For example, panel opening 58 may be fastened shut.

An upward force applied to spine bar 14 may be adjusted by adjustment of waist belt 12. Straps 26 of waist belt 12, one on either side of spine bar sheath 18, attach to elastic bands 16. A user wearing waist belt 12 typically positions spine bar sheath 18 behind the user.

Thus, waist belt 12 may be configured to support spine bar 14. The attachment of spine bar sheath 18 to waist belt 12 may be such as to enable at least limited relative movement between spine bar sheath 18 and waist belt 12. For example, spine bar sheath 18 may be connected to an end of each strap 26 of waist belt 12 by an elastic band 16. Elastic bands 16 may enable relative motion between spine bar sheath 18 and waist ban 12. For example, enabling such relative may enable a user wearing load carrier device 10 to bend or move freely. Elastic band 16 may be constructed with an elastic material, e.g. silicone. Alternatively, elastic band 16 may include an elastic rubber or plastic band, a flexible rope, cord or band; a spring; or any other suitable elastic connector known in the art.

Attachment of elastic band 16 to spine bar sheath 18 may be such that elastic band 16 attaches to spine bar sheath 18 at an oblique angle to the horizontal. For example, in accordance with some embodiments of the present invention, elastic band 16 may be in the form of a silicone elastic ring that is loop about a groove along the outer perimeter of spine bar sheath 18. Alternatively, ends of each elastic band 16 may be attached to spine bar sheath 18. For example, such an attachment may include screws, rivets, stitching, laces, loops or eyelets, or any other suitable method known in the art for connecting an end of an elastic band.

Typically, each elastic band 16 is threaded through a loop 27 at a rearmost end of each strap 26 of waist belt 12. For example, fabric at the rearmost end of strap 26 may be bent or folded over on itself (and sewn shut or otherwise caused to adhere to itself) so as to form loop 27. Alternatively, elastic band 16 may be attached to an end of a strap 26 of waist belt 12 using any other connection method known in the art.

Elastic bands 16, straps 26, and spine bar sheath 18, in accordance with embodiments of the present invention, are configured to apply a lifting force to spine bar sheath 18 by manipulation of straps 26. Pulling straps 26 forward and away from spine bar sheath 18 may apply tension to elastic bands 16. Application of tension to elastic bands 16 may apply a lifting force on spine bar sheath 18.

FIG. 3A illustrates application of upward force by a load carrier in accordance with an embodiment of the present invention. FIG. 3B is another view of application of upward force by a load carrier device.

For example, straps 26 may be pulled forward in the direction of arrows 36, applying tension to each elastic band 16. Such applied tension to elastic band 16 may apply an upward force to spine bar sheath 18 as indicated by arrow 38. For example, forward tension may be applied to strap 26 by pulling on a strap extension 26*a* of strap 26 that extends forward from slide adjuster ring 34. Thus, pulling forward on strap 26 of waist belt 12 may raise spine bar sheath 18, and thus raise spine bar 14. Waist belt 12 may be configured to maintain the applied tension. For example, strap 26 may be provided with a stop arrangement that cooperates with a ring or loop on waist belt 12 to prevent backward motion of strap 26. A stop arrangement, such as slide adjuster ring 34, may cooperate with strap loop 35 of waist belt 12 to maintain forward tension on strap 26, and thus an upward force on spine bar 14.

Reversing the motion may lower spine bar sheath 18, and lower spine bar 14. For example, manipulating a flap of releasing strap 26 of waist belt 12 that extends forward from slide adjuster ring 34 may release strap 26 of waist belt 12. Releasing strap 26 may thus release a lifting force applied to spine bar sheath 18. Releasing the lifting force may then enable spine bar sheath 18 to fall, lowering spine bar 14.

Spine bar 14 may be provided with engaging structure, e.g. in the form of upper connector 15A and lower connector 15B, for connecting to a load to be carried or to torso harness 28. For example, upper connector 15A and lower connector 15B may include prongs 17 for engaging structure on a torso harness 28, such as webbing (e.g. similar to webbing 54 shown in FIG. 5C). In the illustrated embodiment, upper connector 15A is fixed to an upper end of spine bar 14. Lower connector 15B is movable up and down, as illustrated by arrows 39, along spine bar 14. By moving lower connector 15B up and down along spine bar 14, upper connector 15A and lower connector 15B' may be made to connect to or be released from the structure on torso harness 28. When upper connector 15A and lower connector 15B connect to torso harness 28, torso harness 28 may be held fast to spine bar 14. When upper connector 15A and lower connector 15B release torso harness 28, torso harness 28 may be detached or removed from spine bar 14.

Various loads may be attached to torso harness 28. Such loads may be carried by various load carrying accessories. Such load carrying accessories may be attached directly to torso harness 28, or as part of a multi-component load carrying accessory. For example, a load carrying accessory may include a pouch, a bag, a container for fluids (e.g. a hydration system), holster, or tool case. A multi-component load carrying accessory may include, for example, a backpack or a panel with loops or other components for carrying loads.

Figure 4:
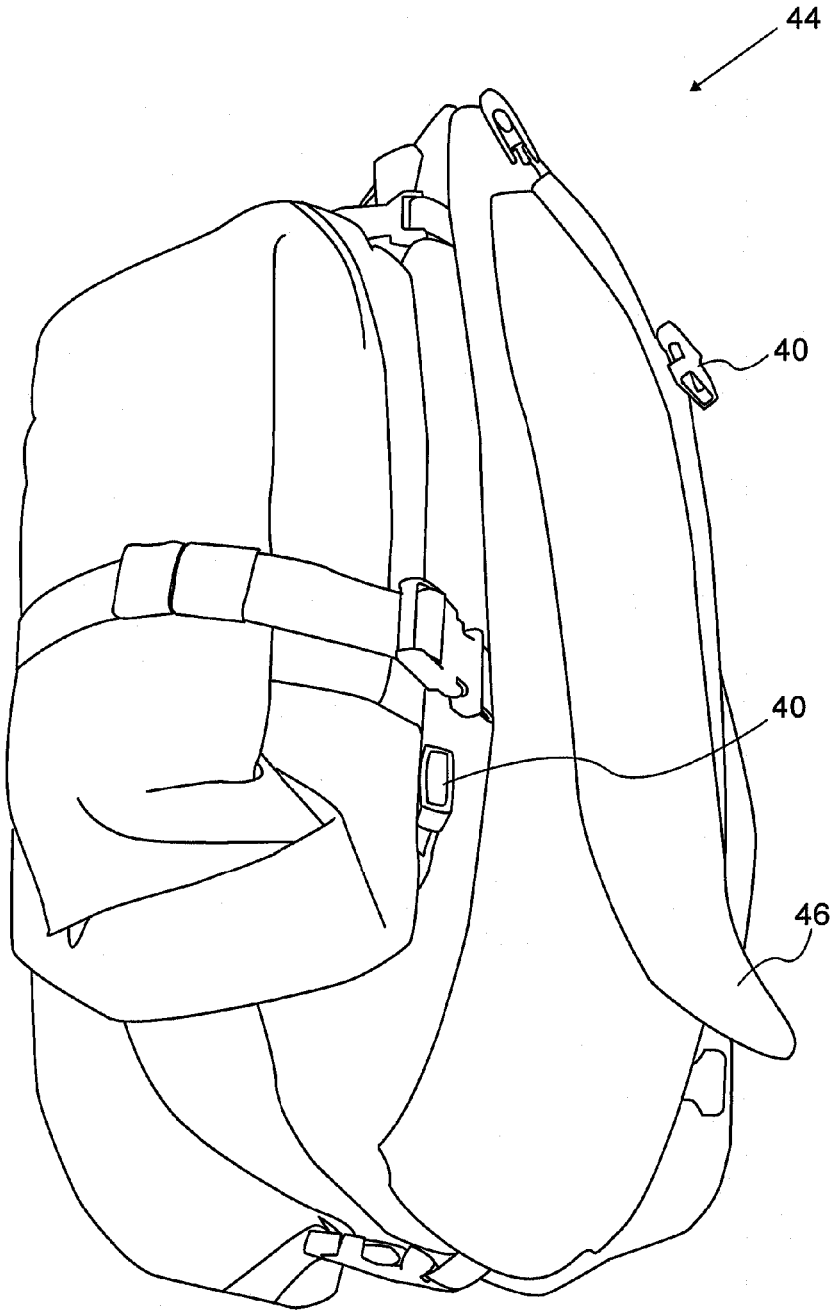
FIG. 4 shows an example of a backpack designed to be carried by a load carrier device in accordance with an embodiment of the present invention.

FIG. 4 shows an example of a backpack designed to be carried by a load carrier device in accordance with some embodiments of the present invention. Typically, the size, configuration, and arrangement of backpack 44 may vary in accordance with an intended use or mission. Backpack 44 as shown should be understood to be a single example of the various possible configurations of backpacks or other carrier components designed to be worn on a user's back. For example, possible configurations or models of a backpack 44 may vary as to the number of, and the distribution of, compartments, pouches, or other attachment or carrying devices (e.g. hooks, loops, straps, belts, rings, buttons, snaps, hook-and-eye fasteners, clips, sleeves, or pockets).

Backpack 44 may include a backpack tab 46. Backpack tab 46 typically includes a stiffened material, such a metal or plastic. Thus, when backpack tab 46 is inserted into an appropriate slot or pocket, such as tab pocket 24 of lower torso harness 27 (FIG. 2A), backpack 44 may be supported by torso harness 28. Typically, backpack 44 is provided with one or more additional or alternative attachment devices 40. Such additional attachment devices may include, for example, straps, hooks or eyes, buckles, laces, hook-and-loop fastener material, pins, clips, snaps, buttons or button holes, zippers, magnets, or any other suitable attachment device known in the art. Attachment devices 40 may attach to mating attachment devices 40 on load carrier device 10, or to mating attachment devices on other components of a load (e.g. a front or side panel). Attaching attachment devices 40 to mating devices may provide additional stability for backpack 44, or to provide an alternative support to backpack tab 46. For example, attachment of attachment devices 40 may ensure that the center of gravity of backpack 44 remains close to the center of gravity of a user wearing load carrier device 10.

Figure 5B:
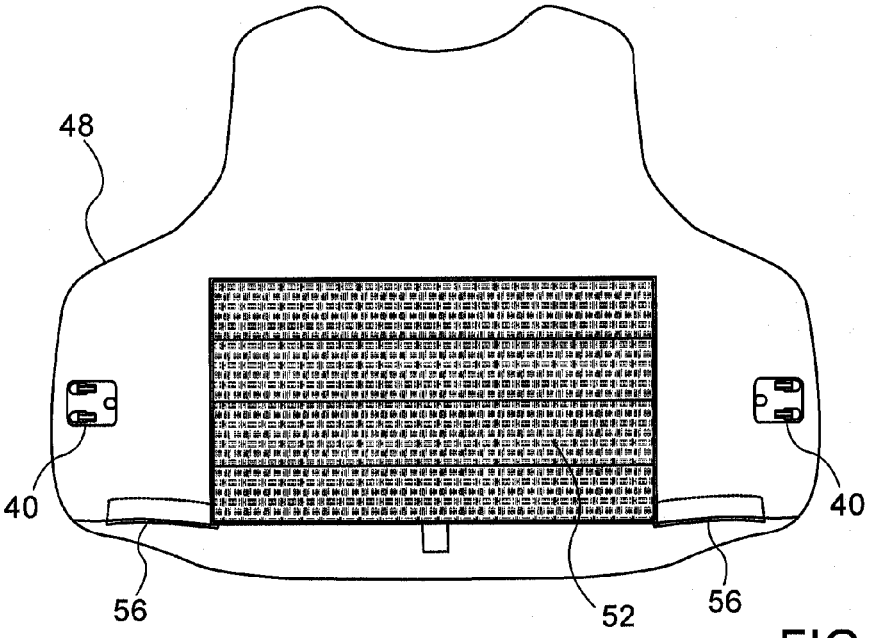
Figure 5C:
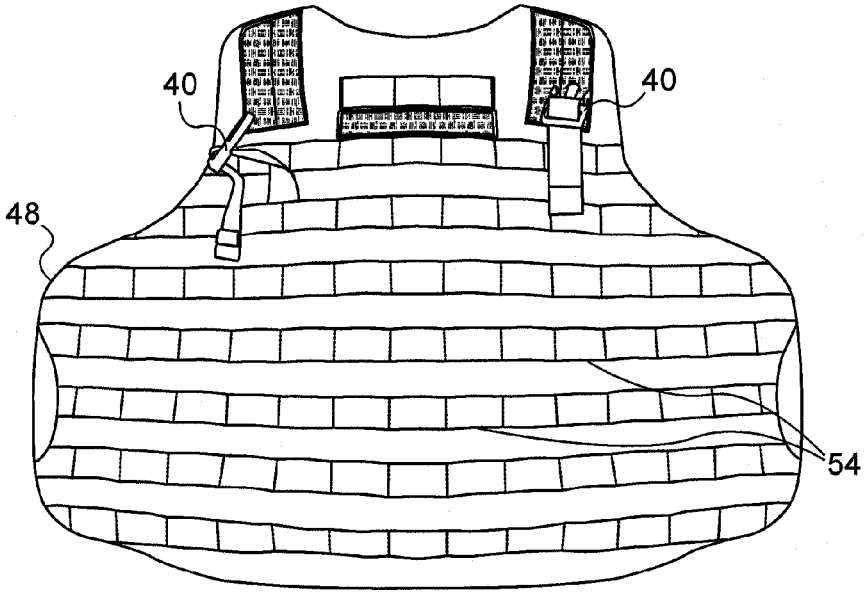

FIG. 5A is a front view of the load carrier device shown in FIG. 1, when worn by a user. FIG. 5B shows an inward facing surface of a panel for attachment to the front of the load carrier device shown in FIG. 5A. FIG. 5C shows an outward facing surface of the panel shown in FIG. 5B. Front panel 48 may be configured to attach to a side of load carrier device 10 that typically faces the front of a user wearing load carrier device 10. Front panel 48 may include attachment surface 52 on an inward-facing surface of front panel 48. For example, attachment surface 52 may include a region of hook-and-loop fastener material. Attachment surface 52 may attach to a mating outward-facing attachment surface 51*b* on abdomen flap 50*b* of lower torso harness 27. Various attachment devices 40 on front panel 48 may attach to corresponding attachment devices 40 on torso harness 28.

Typically, front panel 48 may be configured or selected in accordance with an intended use or mission. For example, an outward-facing surface of front panel 48 may be provided with various attachment means or devices, such as webbing 54 (e.g. pouch attachment ladder system—PALS—webbing), to which various carriers or load-carrying accessories may attach. Suitable carriers may include, for example, pouches, compartments, pockets, bags, bottles, canteens, loops, hooks, or any other suitable carrier. Alternatively to, or in addition to, webbing 54, attachment devices may include hooks, clips, pins, latches, buttons, button holes, zippers, magnets, snaps, laces, belts, buckles, elastic bands, hook-and-loop fastener surfaces, or any other suitable attachment devices.

Front panel 48 may incorporate a padding or lining. Such a padding or lining may include an integrated soft ballistic panel material. For example, an integrated soft ballistic panel may be enclosed by layers of fabric.

Front panel 48 may typically include a one or more compartments, chambers, or pockets for holding a panel or plate. Plate chamber opening 56 for insertion of such a plate may be located on a downward facing edge of front panel 48. Inserted plates may include, for example, rigid ceramic ballistic plates, or other body armor components. The shape of an inserted plate may closely match the shape the plate chamber into which it is inserted. Attachment or closure means may be provided to hold a panel in place within the plate chamber. For example, plate chamber opening 56 may be fastened shut.

A user may assemble and put on load carrier device 10 and associated load carriers and load carrying accessories as follows: Spine bar 14 may be inserted into spine bar opening 22 of spine bar sheath 18 on waist belt 12. Spine bar 14 may be inserted into sleeve 32 of lower torso harness 27. The end of spine bar 14 may then be inserted through spine bar sleeve 31 of shoulder harness 29, and into spine bar pocket 33 of lower torso harness 27. Shoulder straps 30 of shoulder harness 29 may be secured to lower torso harness 27, e.g. by connecting each shoulder strap connector 41*a* to a mating shoulder strap connector 41*b*. Thus, load carrier device 10 may be assembled.

With abdomen closure flaps 50*a* and 50*b* unconnected and open, a user's arms may be placed through shoulder straps 30. Alternatively, shoulder straps 30 may be placed over the user's shoulders, and each shoulder strap connector 41*a* may be connected to a mating shoulder strap connector 41*b* so as to secure shoulder straps 30 to the user.

Closing device 13 may be closed to secure waist belt 12 to the user's waist. Abdomen flaps 50*a* and 50*b* may be closed to secure the lower torso harness 27 to the user's lower torso. Shoulder straps 30 may be adjusted in order to secure torso harness 28 to the user's shoulders.

A front panel 48 may be attached to the front of torso harness 28. For example, attachment panel 52 of front panel 48 may attach to attachment panel 51*b* of torso harness 28. Various attachment devices 40 may also secure front panel 48 of load carrier device 10.

A backpack 44 may be attached to torso harness 28. For example, a backpack tab 46 of backpack 44 may be inserted into tab pocket 24 of lower torso harness 27. Various attachment devices 40 may also serve to secure backpack 44 to torso harness 28.

Figure 6:
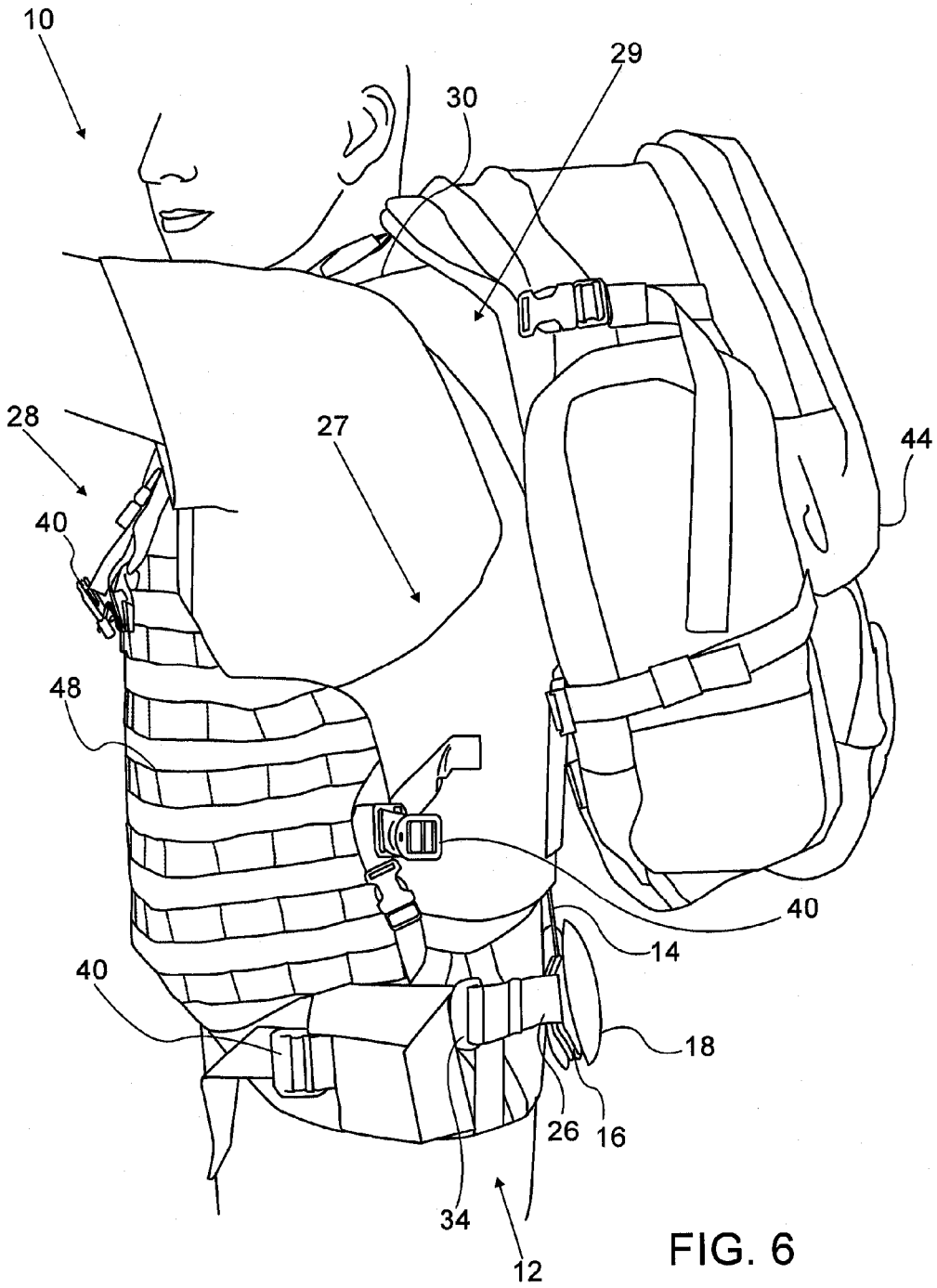
FIG. 6 shows a load carrier device in accordance with an embodiment of the present invention, including a backpack and front panel.

FIG. 6 shows a load carrier device in accordance with an embodiment of the present invention, including a backpack and front panel.

A user wearing load carrier device 10 may manipulate straps 26 of waist belt 12 so as to adjust the distribution of the weight of the carried load (e.g. front panel 48 and backpack 44) between the user's shoulders and waist.

For example, a user may release straps 26 of waist belt 12. As described above, releasing straps 26 (which cooperate via elastic bands 16) may relax an upward force exerted on spine bar 14. Releasing an upward force on spine bar 14 may cause some or all of the weight of a load carried by load carrier device 10 to shift to shoulder straps 30.

On the other hand, a user may pull forward on straps 26 of waist belt 12. As described above, pulling forward on straps 26 may apply an upward force on spine bar 14 (via tension applied to elastic bands 16). The upward force on spine bar 14 may be transmitted to torso harness 28. The upward force on spine bar 14 may shift some or all of the weight of the load from shoulder straps 30 to spine bar sheath 18 and waist belt 12.

Thus, by manipulating strap 26*s* of waist belt 12, a user may dynamically shift or redistribute a load carried by load carrier device 10 between the user's waist and shoulders. For example, the user may redistribute the weight so as to increase comfort, or to relieve fatigue of the shoulders and back, or of the waist.

A load carrier device in accordance with the present invention may enable a user to carry as part of a single integrated unit loads that might otherwise be carried by separate units. For example, the load carrier device may carry body armor, may carry equipment typically carried by a tactical vest (e.g. various pouches and equipment holders), and carry a load in an integrated backpack. A user may thus adjust a weight distribution of all loads carried with a single action. The integration of the various components may also ensure stability of the user. On the other hand, modularity of components of the load carrier device (as well as elastic components) may minimize any restriction on the flexibility, mobility of the user.

It should be clear that the description of the embodiments and attached Figures set forth in this specification serves only for a better understanding of the invention, without limiting its scope.

It should also be clear that a person skilled in the art, after reading the present specification could make adjustments or amendments to the attached Figures and above described embodiments that would still be covered by the present invention.

The invention claimed is:

1. A load carrier device for enabling a user to carry a load, the device comprising:

a belt for fastening about a waist of the user;

an element of substantial vertical rigidity configured to exert a lifting force on the load when the load is attached to shoulder straps on shoulders of the user;

a support attached via an adjustable elastic connection to the belt for supporting a lower end of the element of substantial vertical rigidity so as to enable the element of substantial vertical rigidity and the load to rotate relative to the belt; and a strap attached to the elastic connection to adjust a tension of the adjustable elastic connection so as to adjust a distribution of a weight of the load between the shoulders and the waist of the user.

2. The device of claim 1, wherein the element of substantial vertical rigidity includes one or more connectors for connecting to the load or to a harness that includes the shoulder straps.

3. The device of claim 1, wherein the elastic connection comprises a sheath elastically connected to the belt for supporting a lower end of the element of substantial vertical rigidity.

4. A device as claimed in claim 1, wherein the strap comprises a stop arrangement for maintaining the applied tension.

5. A device as claimed in claim 1, wherein the elastic connection comprises a silicone band.

6. The device of claim 1, comprising the shoulder straps.

7. The device of claim 6, wherein the shoulder straps are part of a harness.

8. The device of claim 7, wherein the harness comprises webbing.

9. The device of claim 8, wherein the element of substantial vertical rigidity includes one or more connectors for connecting to the webbing.

10. The device of claim 7, wherein the harness comprises abdomen flaps for fastening about the torso of the user.

11. The device of claim 7, wherein the harness comprises an attachment element for attaching a load-carrying accessory.

12. The device of claim 11, wherein the attachment element is selected from a group of attachment elements consisting of: a surface of hook-and-loop fastener material, a buckle, a strap, and a tab pocket.

13. The device of claim 7, wherein the harness comprises a lower torso harness that includes abdomen flaps for fastening around a lower torso of the user, and a shoulder harness that includes the shoulder straps, the lower torso harness and the shoulder harness being separately attachable to the element of substantial vertical rigidity.

14. The device of claim 7, wherein the harness comprises an integrated soft ballistic panel.

* * * * *